United States Patent [19]

Harandi

[11] Patent Number: 4,922,048

[45] Date of Patent: May 1, 1990

[54] MEDIUM-PORE ZEOLITE OLEFINIC NAPHTHA BY-PRODUCT UPGRADING

[75] Inventor: Mohsen N. Harandi, Lawrenceville, N.J.

[73] Assignee: Mobil Oil Corp., New York, N.Y.

[21] Appl. No.: 257,894

[22] Filed: Oct. 14, 1988

[51] Int. Cl.[5] ..... C07C 2/12

[52] U.S. Cl. ..... 585/310; 585/312; 585/313; 585/322; 585/407; 585/533

[58] Field of Search ..... 585/322, 330, 407, 412, 585/424, 533, 736, 739, 502, 310, 312, 313; 208/49, 63, 70, 74

[56] References Cited

U.S. PATENT DOCUMENTS

| | | | |
|---|---|---|---|
| 3,950,242 | 4/1976 | Garwood et al. | 208/70 |
| 3,992,466 | 11/1976 | Plank et al. | 585/533 |
| 4,324,940 | 4/1982 | Dessau | 585/407 |
| 4,388,176 | 6/1983 | Pratt et al. | 208/80 |
| 4,433,185 | 2/1984 | Tabak | 585/322 |
| 4,456,779 | 6/1984 | Owen et al. | 585/424 |
| 4,483,760 | 11/1984 | Tabak et al. | 585/322 |
| 4,511,747 | 4/1985 | Wright et al. | 585/424 |
| 4,517,399 | 5/1985 | Chester et al. | 585/502 |
| 4,582,949 | 4/1986 | Kieffer | 585/525 |
| 4,753,720 | 6/1988 | Morrison | 208/70 |
| 4,777,316 | 10/1988 | Harandi et al. | 585/533 |
| 4,784,745 | 11/1988 | Nace | 208/70 |
| 4,788,364 | 11/1988 | Harandi | 585/322 |
| 4,808,295 | 2/1989 | Nemetmavrodin | 585/412 |

*Primary Examiner*—Anthony McFarlane

*Attorney, Agent, or Firm*—Alexander J. McKillop; Charles J. Speciale; Robert B. Furr, Jr.

[57] ABSTRACT

A process is provided for upgrading the olefinic gasoline by-product of low-severity medium-pore zeolite catalyzed hydrocarbon conversion processes including catalytic dewaxing and olefin oligomerization. The olefinic gasoline stream is upgraded in a high-severity catalytic conversion process which may be carried out in a catalytic cracking unit primary or secondary riser reactor or in a second medium-pore zeolite-catalyzed reaction zone. The olefinic gasoline stream may be mixed with a $C_2$–$C_7$ aliphatic stream before upgrading the mixture in the high-severity catalytic conversion process. Examples of such low-severity medium-pore zeolite catalyzed hydrocarbon conversion processes include distillate and lubricant dewaxing as well as olefin oligomerization.

34 Claims, 6 Drawing Sheets

MEDIUM-PORE ZEOLITE OLEFINIC NAPHTHA BY-PRODUCT UPGRADING

BACKGROUND OF THE INVENTION

This invention relates to the upgrading of gasoline boiling range components produced in low-severity catalytic hydrocarbon conversion processes. In particular, this invention relates to upgrading gasoline boiling range components produced as a by-product by the reaction of hydrocarbon feedstocks at low severity in the presence of a medium-pore zeolite catalyst. The upgrading is affected in a high severity acid catalyzed reaction in which other feeds may also be upgraded. Such processes include catalytic dewaxing of distillates and lubes as well as catalytic oligomerization of olefins into heavier hydrocarbon fractions.

Dewaxing

Catalytic dewaxing of hydrocarbon oils to reduce the temperature at which precipitation of waxy hydrocarbons occurs is a known process and is described, for example, in the Oil and Gas Journal, Jan. 6, 1975, pages 69–73. A number of patents have also described catalytic dewaxing processes. For example, U.S. Pat. RE. No. 28,398 describes a process for catalytic dewaxing with a catalyst comprising a medium-pore zeolite and a hydrogenation/dehydrogenation component. U.S. Pat. No. 3,956,102 describes a process for hydrodewaxing a gas oil with a medium-pore zeolite catalyst. U.S. Pat. No. 4,100,056 describes a Mordenite catalyst containing a Group VI or a Group VIII metal which may be used to dewax a distillate derived from a waxy crude. U.S. Pat. No. 3,755,138 describes a process for mild solvent dewaxing to remove high quality wax from a lube stock, which is then catalytically dewaxed to specification pour point. Such developments in catalytic dewaxing have led to the MLDW (Mobil Lube Dewaxing) and MDDW (Mobil Distillate Dewaxing) processes.

Catalytic dewaxing processes may be followed by other processing steps such as hydrodesulfurization and denitrogenation in order to improve the qualities of the product. For example, U.S. Pat. No. 3,668,113 describes a catalytic dewaxing process employing a Mordenite dewaxing catalyst which is followed by a catalytic hydrodesulfurization step over an alumina-based catalyst. U.S. Pat. No. 4,400,265 describes a catalytic dewaxing-/hydrodewaxing process using a zeolite catalyst having the structure of ZSM-5 wherein gas oil is catalytically dewaxed followed by hydrodesufurization in a cascade system. The foregoing dewaxing processes exemplify low-severity medium-pore catalyzed dewaxing processes which produce a low octane naphtha by-product. Another example of a low severity medium-pore catalyzed conversion reaction is olefin oligomerization.

Olefin Oligomerization

Recent developments in zeolite catalysts and hydrocarbon conversion methods and apparatuses have created interest in utilizing olefinic feedstocks for producing heavier hydrocarbons, such as $C_5+$ gasoline, distillate or lubes. These developments form the basis of the Mobil olefins to gasoline/distillate (MOGD) method and apparatus, and the Mobil olefins to gasoline/distillate/lubes (MOGDL) method and apparatus.

In MOGD and MOGDL, olefins are catalytically converted to heavier hydrocarbons by catalytic oligomerization using an acid crystalline zeolite, such as a zeolite catalyst having the structure of ZSM-5. Process conditions can be varied to favor the formation of either gasoline, distillate or lube range products. U.S. Pat. Nos. 3,960,978 and 4,021,502 to Plank et al. disclose the conversion of $C_2$–$C_5$ olefins alone or in combination with paraffinic components, into higher hydrocarbons over a crystalline zeolite catalyst. U.S. Pat. Nos. 4,150,062; 4,211,640 and 4,227,992 to Garwood et al. have contributed improved processing techniques to the MOGD system. U.S. Pat. No. 4,456,781 to Marsh et al. has also disclosed improved processing techniques for the MOGD system.

U.S. Pat. Nos. 4,433,185 and 4,483,760 to Tabak disclose two-stage catalytic processes for upgrading hydrocarbon feedstocks, the texts of which are incorporated by reference as if set forth at length herein.

The '185 patent to Tabak teaches a process for converting an olefinic feedstock containing ethene and heavier alkenes to a product rich in distillate and olefinic gasoline. Effluent from a first stage distillate mode reactor is flashed to separate an ethylene-rich product stream which is then charged to a second stage gasoline mode reactor. A disadvantage of the process taught by '185 is that the highly olefinic gasoline product stream is of a relatively low octane and reduces the gasoline pool octane.

The '760 patent to Tabak teaches a process for catalytically dewaxing a middle distillate separating an olefinic by-product from the dewaxed distillate product stream, and upgrading the separated olefinic by-product in a second catalytic reactor. No mention is made of upgrading a gasoline fraction at temperatures above 900° F. In addition, the second catalytic reactor is used solely to upgrade the olefinic gasoline and upgrades no other feed. Further, the second catalytic reactor is operated to convert at least 10 wt. % of the olefinic by-product fraction to fuel oil (material boiling above 380° F.).

Olefinic feedstocks may be obtained from various sources, including from fossil fuel processing streams, such as gas separation units, from the cracking of $C_2+$ hydrocarbons, such as LPG (liquified petroleum gas), from coal by-products, from various synthetic fuel processing streams, and as by-products from fluid catalytic cracking (FCC) and thermal catalytic cracking (TCC) process units. U.S. Pat. No. 4,100,218 to Chen et al. teaches thermal cracking of ethane to ethylene, with subsequent conversion of ethylene to LPG and gasoline over a zeolite catalyst having the structure of ZSM-5.

The conversion of olefins in an MOGDL system may occur in a gasoline mode and/or a distillate/lube mode. In the gasoline mode, the olefins are typically oligomerized at temperatures ranging from 400° to 800° F. and pressures ranging from 10 to 1000 psia. To avoid excessive temperatures in an exothermic reactor, the olefinic feed may be diluted. In the gasoline mode, the diluent may comprise light hydrocarbons, such as $C_3$–$C_4$ from the feedstock and/or recycled from debutanized oligomerized product. In the distillate/lube mode, olefins are catalytically oligomerized to distillate at temperature ranging from 350° to 600° F. and pressures ranging from 100 to 3000 psig. The distillate is then upgraded by hydrotreating and separating the hydrotreated distillate to recover lubes.

These low severity catalytic hydrocarbon conversion processes typically produce a highly olefinic gasoline stream having a motor clear octane number in the range of 76 to 81. The product stream's low octane number makes it unsuitable for use as a gasoline blending component.

Catalytic reforming is widely used to increase octane in gasoline boiling range feedstocks. The nature of the reforming reaction is such that a paraffinic feedstock is preferred over an olefinic feedstock. Olefinic feedstocks tend to form excessive amounts of coke in the reformer reactors and cause more rapid deactivation of the reforming catalyst. Consequently, reformers are typically equipped with pretreaters which catalytically react naphtha with hydrogen to remove sulfur compounds and to saturate olefins. Sulfur compounds are catalyst poisons and are removed from the process stream by catalytic addition of hydrogen to form $H_2S$. Hydrogen consumption is related to the concentration of olefinic compounds in pretreater feed and olefinic feeds, therefore, consume more hydrogen during pretreatment than paraffinic feeds, making olefinic feeds more costly to pretreat.

U.S. Pat. No. 3,890,218 to Morrison teaches a reforming process using a crystalline zeolite catalyst having the structure of ZSM-5. The Morrison patent shows a plot of $C_5+$ volume percent recovery as a function of research clear octane number for a given feed and process conditions. For a general discussion of naphtha reforming, see 17 *Kirk Othmer Encyclopedia of Chemical Technology,* 218–220, 3rd edition, 1982.

From the foregoing discussion, it can clearly be seen that it would be highly desirable to upgrade the highly olefinic gasoline by-product of medium-pore zeolite catalyzed reactions without the yield penalty associated with reforming. Further, it would be advantageous to integrate the olefinic gasoline upgrading process with an existing process unit in order to more efficiently utilize the reaction and product recovery sections of the existing unit.

SUMMARY OF THE INVENTION

The invention upgrades highly olefinic gasoline boiling range by product from a low-severity medium-pore zeolite catalyzed reaction. Moreover, the invention integrates the olefinic gasoline upgrading process into the reaction and recovery sections of a second process unit thereby providing a particularly cost effective means of producing high octane gasoline blending stock.

Thus, a novel technique has been found for producing the desirable products of low-severity medium-pore zeolite catalyzed hydrocarbon upgrading processes together with a high octane gasoline stream which comprises:

contacting a hydrocarbon feedstock with a medium-pore zeolite catalyst in a first reaction zone at elevated pressure and moderate temperature to form a first reactor effluent stream;

separating the first reactor effluent stream into a product stream and an olefinic gasoline stream;

contacting the olefinic gasoline stream with a second catalyst under a second set of conversion conditions comprising elevated pressure and elevated temperature to form an upgraded gasoline stream.

The process may further comprise mixing the olefinic gasoline with a $C_2$–$C_7$ aliphatic stream before contacting the mixture with the second catalyst.

Preferred low-severity medium-pore zeolite catalyzed hydrocarbon upgrading processes in which a reaction zone is maintained at elevated pressure and moderate pressure include olefin interconversion, conversion of olefins to gasoline, distillate and lubricant boiling range stocks, distillate dewaxing, and lubricant dewaxing. For the purpose of this disclosure, the term "medium pore zeolite" designates a zeolite having a Constraint Index of between about 1 and 12. Of the medium-pore zeolites, those zeolites having the structure of ZSM-5 are most preferred. Preferred processes for upgrading the resulting olefinic gasoline by-product include olefin isomerization/oligomerization as well as aromatization.

The preferred embodiments of the present invention may be divided into two groups: those employing an independent reaction zone for gasoline upgrading and those which are integrated with a fluidized catalytic cracking process unit. The first group includes processes using a fixed, moving, or fluidized bed of catalyst, preferably medium-pore zeolite catalyst. The second group includes processes in which gasoline is upgraded in a catalytic cracking process unit primary or secondary reactor riser. In the second group of processes, the cracking catalyst alone is sufficient to progress the desired upgrading reactions. Preferably, however, a medium-pore zeolite additive catalyst is also present in the cracking unit riser. Suitable cracking catalysts include both crystalline and amorphous compositions. Zeolites X and Y are examples of preferred cracking catalysts. For a discussion of cracking catalysts, see Venuto and Habib, Fluid Cracking with Zeolite Catalysts, 30–49, Marcel Dekker (1979).

DETAILED DESCRIPTION

Figure 1:
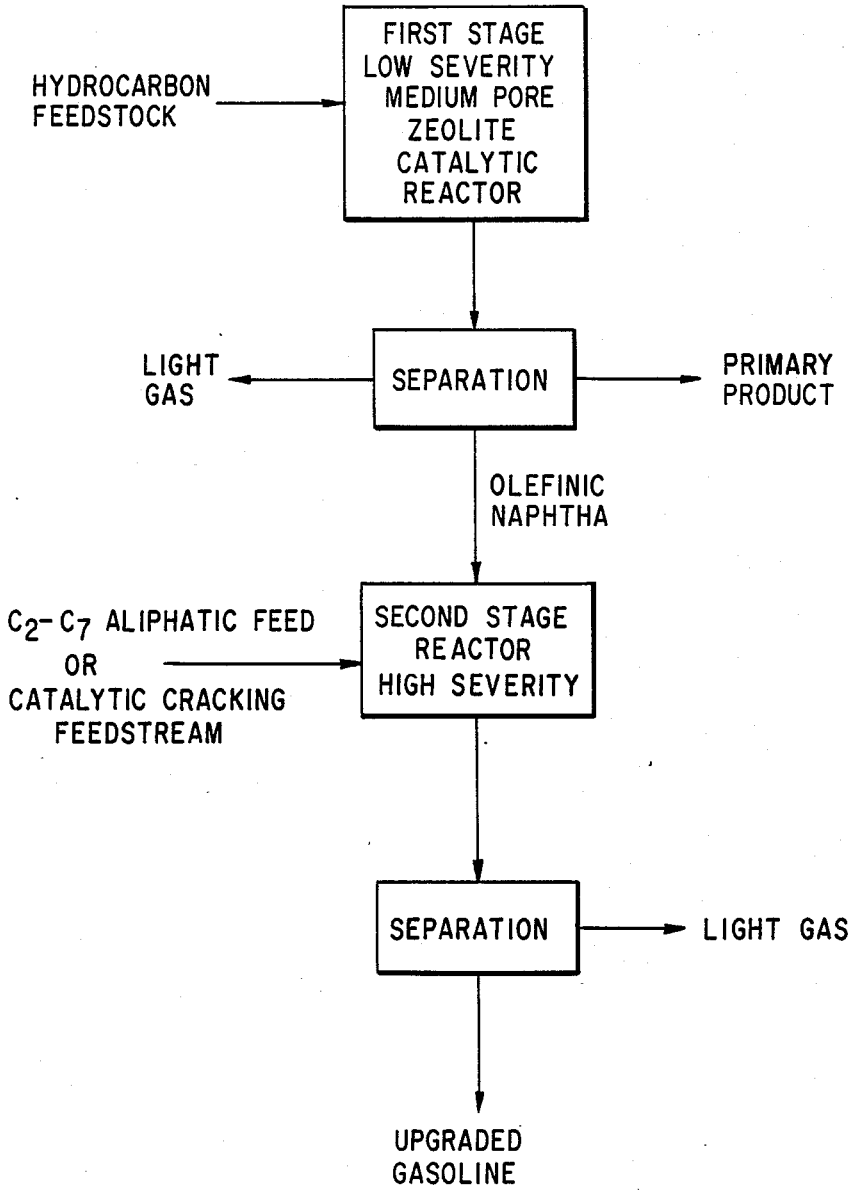
FIG. 1 is a block diagram illustrating the basic steps of the present invention.

The present invention couples a low-severity medium-pore zeolite catalyzed reaction zone with a high-severity medium-pore catalyzed reaction zone so that production of valuable streams by the low-severity zone may be accompanied by production of high octane gasoline.

Examples of low-severity medium-pore zeolite catalyzed reactions include converting $C_2$–$C_6$ olefins to heavier aliphatic stocks including gasoline, distillate, and lube stocks, as well as dewaxing distillate and lube stocks. Process conditions and preferred feedstocks are disclosed in the above-cited patents. Tables 1 and 2 summarize process conditions for the olefin conversion and dewaxing processes, respectively.

Each of these processes produces, as a part of its reactor effluent mixture, gasoline boiling range material. This gasoline stream, when separated, is generally highly olefinic and is of too low an octane number for blending into a saleable product without further treatment. Variations in feedstock and process conditions affect both the volume and the composition of the olefinic gasoline stream produced.

The process of the present invention upgrades this olefinic naphtha stream in a high-severity catalyzed reaction zone. Such reaction zones may be maintained in a main or secondary riser of an FCC (fluid catalytic cracking) unit or in a fixed or fluidized bed reactor. Table 3 summarizes the process conditions for the catalytic upgrading of olefinic gasoline, showing that process conditions may be selected to favor oligomerization or aromatization.

Table 4 shows process conditions for olefinic gasoline upgrading in a single riser FCC unit.

TABLE 1

| | Olefin Interconversion | Olefin to Gasoline & Distillate | Olefin to Gasoline Distillate & Lubricant |
|---|---|---|---|
| Main Purpose of Process | Produce tertiary $C_4$–$C_5$ olefins | Produce distillate components | Produce lubricant components |
| WHSV | Broad: 0.1–250 $hr^{-1}$ Preferred: 0.2–10 $hr^{-1}$ | Broad: 0.1–50 $hr^{-1}$ Preferred: 0.5–10 $hr^{-1}$ | Broad: 0.1–10 $hr^{-1}$ Preferred: 0.2–2 $hr^{-1}$ |
| Operating Temperature | Broad: 232–385° C. (450–725° F.) Preferred: 260–343° C. (500–650° F.) | Broad: 177–371° C. (350–700° F.) Preferred: 204–316° C. (400–600° F.) | Broad: 177–316° C. (350–600° F.) Preferred: 204–316° C. (400–600° F.) |
| Operating Pressure kPa (psig) | Broad: 240–2170 kPa (20–300 psig) Preferred: 790–1480 kPa (100–200 psig) | Broad: 1480–13890 kPa (200–2000 psig) Preferred: 2859–6996 kPa (400–1000 psig) | Broad: 3549–20786 kPa (500–3000 psig) Preferred: 5617–10443 kPa (800–1500 psig) |

TABLE 2

| | Dewaxing Process Conditions | |
|---|---|---|
| | MLDW | MDDW |
| Main purpose of process | Produce dewaxed lubricant stock | Produce dewaxed distillate stock |
| Reactor Inlet Temperature | 260–357° C. (500–675° F.) | 260–454° C. (500–850° F.) |
| Operating Pressure kPa | 170–20,800 kPa (10–3000 psig) | 170–7000 kPa (10–1000 psig) |
| Hydrogen Dosage | 0–3000 SCF/BBl feed | 0–2000 SCF/BBL feed |

TABLE 3

| | Olefinic Gasoline Upgrading Reaction Process Conditions | | | |
|---|---|---|---|---|
| | Oligomerization | | Aromatization | |
| WHSV | Broad range: | 0.3–20 $hr^{-1}$ | Broad range: | 0.3–300 $hr^{-1}$ |
| | Preferred range: | 0.5–5.0 $hr^{-1}$ | Preferred range: | 1–10 $hr^{-1}$ |
| Operating Pressure | Broad: | 240–2170 kPa (20–300 psig) | Broad: | 170–2170 kPa (10–300 psig) |
| | Preferred: | 790–1480 kPa (100–200 psig) | Preferred: | 310–790 kpa (30–100 psig) |
| Operating Temperature | Broad: | 340–540° C. (650–1000° F.) | Broad: | 540–820° C. (1000–1500° F.) |
| | Preferred: | 316–427° C. (600–800° F.) | Preferred: | 560–620° C. (1050–1150° F.) |

TABLE 4

| Process Conditions for Olefinic Gasoline Upgrading in Single-Riser FCC Unit |
|---|
| Catalyst:Feedstock Weight Ratio |
| Broad Range: 0.5–20 |
| Preferred Range: 1–5 |
| Catalyst Contact Time: |

TABLE 4-continued

| Process Conditions for Olefinic Gasoline Upgrading in Single-Riser FCC Unit |
|---|
| Broad Range: 1–50 sec. |
| Preferred Range: 3–5 sec. |
| Reaction Temperature: |
| Broad Range: 427–593° C. (800–1100° F.) |
| Preferred Range: 526–549° C. (980–1020° F.) |

Catalysts

The medium-pore zeolite catalysts useful in the first stage of each of the listed embodiments of the present invention and also preferred for use in the second stage of each listed embodiment have an effective pore size of generally from about 5 to about 8 Angstroms, such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of silicon and aluminum atoms, then access by molecules of larger cross-section than normal hexane is excluded and the zeolite is not of the desired type. Windows of 10-membered rings are preferred, although, in some instances, excessive puckering of the rings or pore blockage may render these zeolite ineffective.

Although 12-membered rings in theory would not offer sufficient constraint to produce advantageous conversions, it is noted that the puckered 12-ring structure of TMA offretite does show some constrained access. Other 12-ring structures may exist which may be operative for other reasons, and therefore, it is not the present intention to entirely judge the usefulness of the particular zeolite solely from theoretical structural considerations.

A convenient measure of the extent to which a zeolite provides control to molecules of varying sizes to its internal structure is the Constraint Index of the zeolite. The method by which the Constraint Index is determined is described in U.S. Pat. No. 4,016,218, incorporated herein by reference for details of the method. U.S. Pat. No. 4,696,732 discloses Constraint Index values for typical zeolite materials and is incorporated by reference as if set forth at length herein.

The medium-pore catalysts particularly useful in the present invention include zeolite catalysts having the structure of ZSM-5, ZSM-11, ZSM-12, ZSM-22, ZSM-23, ZSM-35, ZSM-48 and other similar materials. U.S. Pat. No. 3,702,886 describing and claiming ZSM-5 is incorporated herein by reference. Also, U.S. Pat. RE. No. 29,948 describing and claiming a crystalline material with an X-ray diffraction pattern of ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

ZSM-48 is more particularly described in U.S. Pat. No. 4,375,573, the entire contents of which are incorporated herein by reference.

The zeolites suitable for use in the present invention can be modified in activity by dilution with a matrix component of significant or little catalytic activity.

Embodiments of the invention which integrate the second high-severity reaction zone with a catalytic cracking unit also use a large-pore crystalline zeolite cracking catalyst, examples of which include zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752), merely to name a few, as well as naturally occuring zeolites such as chabazite, faujasite, mordenite and the like. Also useful are the silicon-substituted zeolites described in U.S. Pat. No. 4,503,023. Zeolite Beta is yet another large-pore crystalline silicate which can be used alone or may constitute a component of the mixed catalyst system utilized herein.

It is, of course, within the scope of this invention to employ two or more of the foregoing amorphous and/or large-pore crystalline cracking catalysts as the first catalyst component of the mixed catalyst system. Preferred crystalline zeolite components of the mixed catalyst system herein include the natural zeolites mordenite and faujasite and the synthetic zeolites X and Y with particular preference being accorded zeolites Y, REY, USY and RE-USY.

PROCESS FLOW SCHEME

Referring to FIG. 1, the process of the present invention comprises charging a hydrocarbon feedstock to a first reaction zone where the feedstock contacts a medium-pore zeolite catalyst under low-severity conversion conditions. A mixture of desired products, light hydrocarbon gas and olefinic gasoline flows from the first reaction zone to a separation section. This section generally comprises at least one distillation tower. Olefinic gasoline is charged from the separation section to a second reaction zone where the olefinic gasoline contacts a medium-pore zeolite catalyst under high-severity conversion conditions. The resulting high octane gasoline product is then recovered from the second reaction zone effluent for further processing or blending directly into a gasoline product for sale. For a discussion of such a recovery scheme, see commonly-assigned application Ser. No. 211,611, filed Jun. 27, 1988, which is incorporated herein by reference.

DESCRIPTION OF THE FIRST EMBODIMENT

In a first embodiment of the present invention, a $C_2$–$C_6$ olefinic stream is converted in a first low-severity medium-pore zeolite catalyst bed to a product stream containing olefinic gasoline and heavier products. The gasoline fraction of the product stream is then aromatized and upgraded in the second riser of a two-riser fluid catalytic cracking (FCC) unit. The upgraded gasoline product is then processed with the total FCC gasoline product stream.

As discussed above, the product distribution obtained from the catalytic oligomerization of an olefinic stream may be varied within the gasoline, distillate and lubricant boiling ranges by selecting the corresponding process conditions as shown in Table 1.

Figure 2:
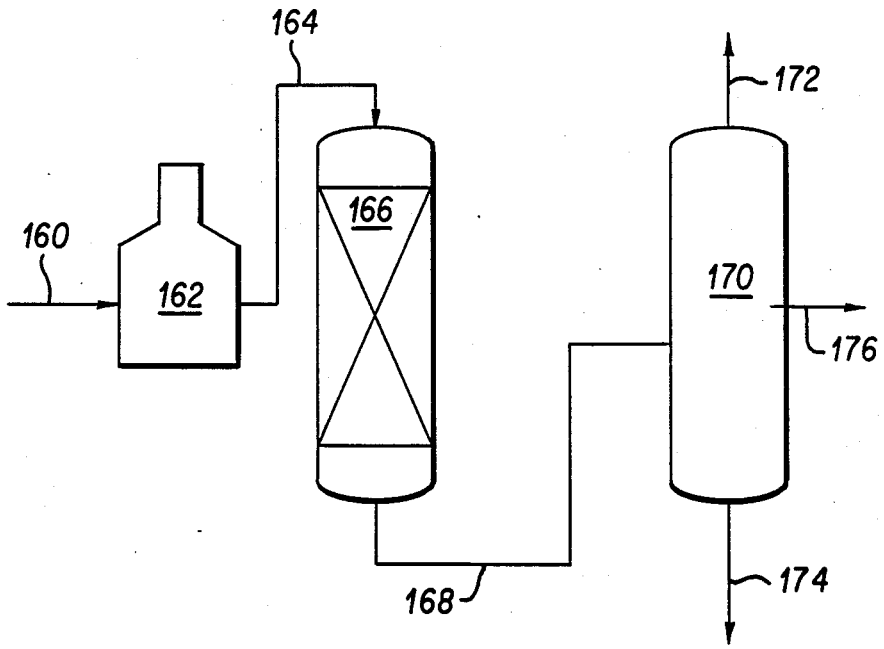
FIG. 2 is a simplified schematic diagram showing a process flow for a process to upgrade aliphatic hydrocarbons.

Referring now to FIG. 2, an olefinic feedstock flowing through line 160 is charged to heater 162 where it is heated to the desired reactor inlet temperature as shown in Table 1, above. The hot effluent stream from heater 162 flows through line 164 and enters reactor 166. Reactor 166 contains one or more medium-pore zeolite catalysts of the type described above.

Reaction products are withdrawn from the reactor through line 168 and charged to separation section 170. The process conditions chosen for reactor 166 will determine the optimum equipment configuration for separation section 170. Such optimization may easily be made by one skilled in the art. For the process conditions shown in Table 1, separation section 170 will comprise at least one distillation tower.

If reactor 166 is operated at the relatively mild olefin oligomerization process conditions, the reactor effluent will typically consist of a largely aliphatic product of olefin isomerization and oligomerization. In this case, a gasoline stream rich in olefins is separated from the reactor effluent mixture in separation section 170 and flows through line 176 to a high severity reaction zone maintained in the second riser of a fluidized catalytic cracking (FCC) unit. A $C_2$–$C_7$ aliphatic stream may optionally be added to line 176 via line 178. It is preferable to use a medium-pore zeolite additive catalyst in conjunction with the cracking catalyst and to add the medium-pore zeolite catalyst to the second riser through line 122 as shown. Distillate boiling range and heavier products flow out of separation section 170 through line 174 while $C_3$ and lighter hydrocarbon gases leave separation section 170 through line 172.

Figure 5:
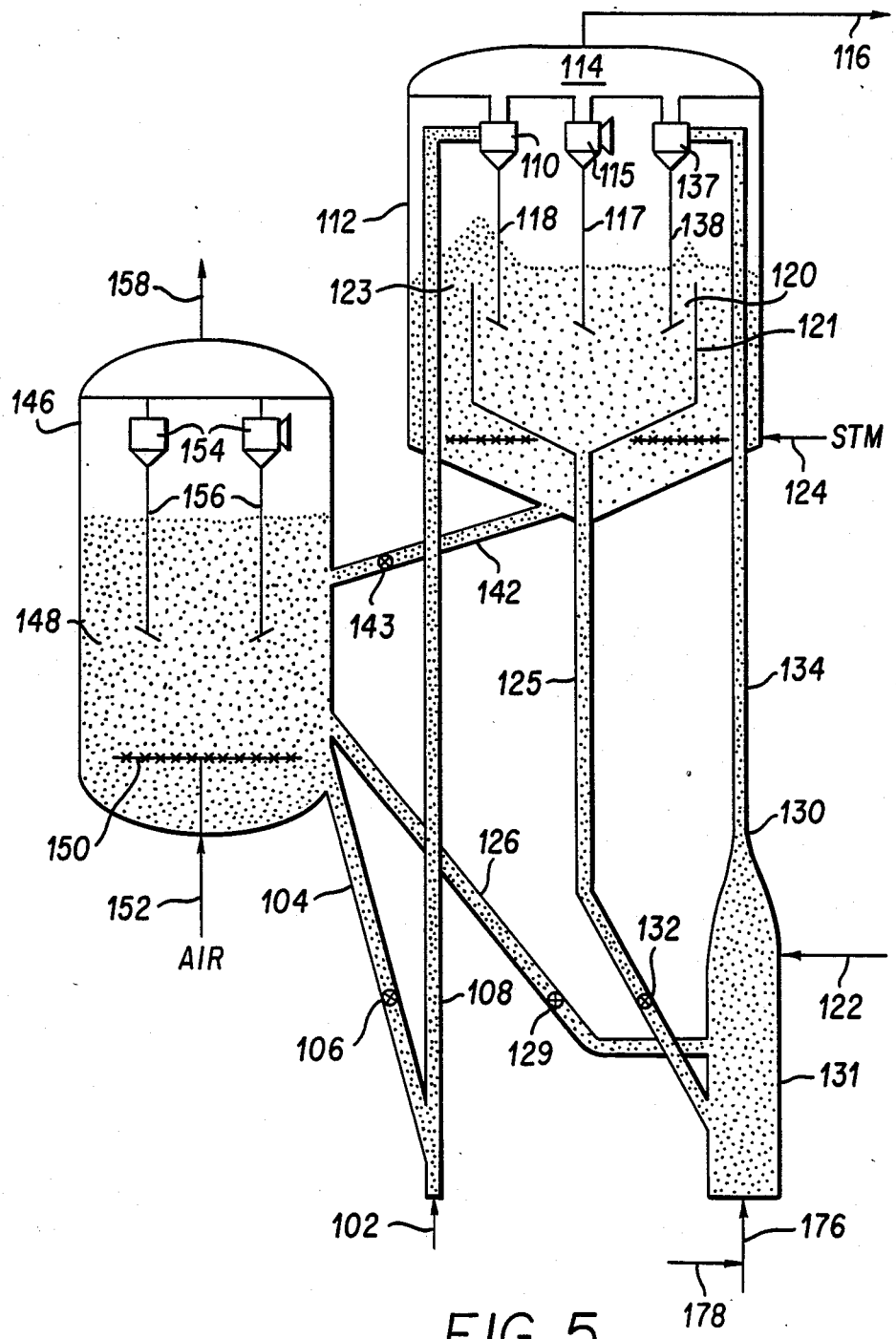
FIG. 5 is a simplified flow diagram showing a dual-riser FCC unit.

FIG. 5 illustrates a dual-riser FCC unit for upgrading both a primary gas oil and/or a residual oil feed as well as a secondary olefinic gasoline feed. A heavy virgin gas oil and/or a residual oil feed is introduced to the FCC unit by conduit 102 where it is combined with hot regenerated cracking catalyst preferably together with a relatively minor percentage of the total inventory of medium-pore additive catalyst in conduit 104 equipped with flow control valve 106 to form a suspension of catalyst particles in oil vapors which pass upwardly through first riser 108. The conditions in the first riser include a temperature of from about 480° C. to 620° C. (900° F. to about 1150° F.) and typically from about 490° C. to 540° C. (925° F. to about 1000° F.), a catalyst to feed ratio of from about 3:1 to about 20:1 and preferably from about 4:1 to about 10:1 and a catalyst contact time of from about 0.5 to about 30 seconds and preferably from about 1 to about 15 seconds. Under these conditions, substantial quantities of gasoline boiling range material and light hydrocarbons, e.g. paraffins and olefins containing more than 4 carbon atoms, will be obtained. These products are separated after removal of catalyst therefrom in a cyclone separator 110 housed in the upper portion of stripping unit 112. Separated hydrocarbon vapors pass into plenum chamber 114 and are removed therefrom by conduit 116 for separation in downstream operations. Catalyst separated in cyclone 110 is conveyed by dipleg 118 into the bed of catalyst 123. Stripped, spent cracking catalyst continues its downward flow movement and is withdrawn from the stripper through conduit 142 equipped with valve 143 where it is conveyed to regenerator 146.

Hot freshly regenerated cracking catalyst is conveyed through conduit 126 equipped with valve 129 to lower region 131 of second riser 130 where it combines with stripped catalyst, preferably medium-pore zeolite catalyst, conveyed through return conduit 125, medium-pore catalyst present in lower region 131 and olefinic gasoline recovered from the effluent of a low-severity medium-pore zeolite catalyzed reaction zone flowing through line 176 as described above. Temperature control within this region can be regulated by controlling the amount of hot, freshly regenerated cracking catalyst introduced thereto. The conditions of conversion of the olefinic gasoline feed in the lower region of riser 131 can include a temperature of from about 950° to about 1200° F. and preferably from about 1000° to about 1100° F., a catalyst to feed ratio of from about 0.5:1 to about 20:1 and preferably from about 1:1 to about 5:1 and a catalyst contact time of from about 1 to about 50 seconds and preferably from about 3 to about 5 seconds.

The products of conversion from second riser 130 preferably are passed to plenum chamber 114 and are removed therefrom together with the products of conversion of first riser 108 by conduit 116 communicating with a product recovery section (not shown).

The stripped spent catalyst particles are passed by conduit 142 equipped with valve 143 to a catalyst regeneration unit representated by regenerator 146 containing a dense fluid bed of catalyst 148. Regeneration gas such as air is introduced to the lower portion of regenerator 146 by air distributor 150 supplied by conduit 152. Cyclone separators 154 provided with diplegs 156 separates entrained catalyst particles from flue gases and return the separated catalyst to the fluid bed of catalyst. Flue gases pass from the cyclones into a plenum chamber and are removed therefrom by conduit 158. Hot regenerated cracking catalyst is returned to the lower region of first riser 108 by conduit 104 through a valve 106 and the lower and upper regions of second riser 130 by conduits 126 and 135 as discussed above to participate in another cycle of conversion.

DESCRIPTION OF THE SECOND EMBODIMENT

In a second embodiment, a $C_2$–$C_6$ olefinic stream is converted in a first low-severity medium-pore zeolite catalyst bed to a product stream containing gasoline and heavier products as in the first embodiment. However, in the second embodiment, the olefinic gasoline is aromatized and upgraded in a single-riser FCC unit.

As in the first embodiment, the zeolite catalyst bed may be fluidized or fixed. Further, process conditions may be varied as in the first embodiment to attain the desired product mixture.

The olefinic gasoline is injected at a point in the FCC riser above the primary gas oil feed to avoid cracking the gasoline into light hydrocarbon gas. Catalytic cracking is endothermic and temperature decreases as the reactants flow through the length of the riser. Consequently, the olefinic gasoline injection point may be determined by matching the desired process conditions with the temperature profile of the reactor riser.

Referring now to FIG. 2, an olefinic feedstock flowing through line 160 is charged to heater 162 where it is heated to the desired reactor inlet temperature as shown in Table 1, above. The hot effluent stream from heater 162 flows through line 164 and enters reactor 166.

Reaction products are withdrawn from the reactor through line 168 and charged to separation section 170.

A gasoline stream rich in olefins is separated from the reactor effluent mixture in separation section 170 and flows through line 176 to a secondary feed injection point of a single-riser of a fluidized catalytic cracking (FCC) unit. A $C_2$–$C_7$ aliphatic stream may optionally be added to line 176 through line 178. Distillate boiling range and heavier products flow out of separation section 170 through line 174 while $C_3$ and lighter hydrocarbon gases leave separation section 170 through line 172. As in the first embodiment, if reactor 166 is operated at progressively more severe operating conditions, the flow of gasoline boiling range material through line 176 will decrease.

Figure 4:
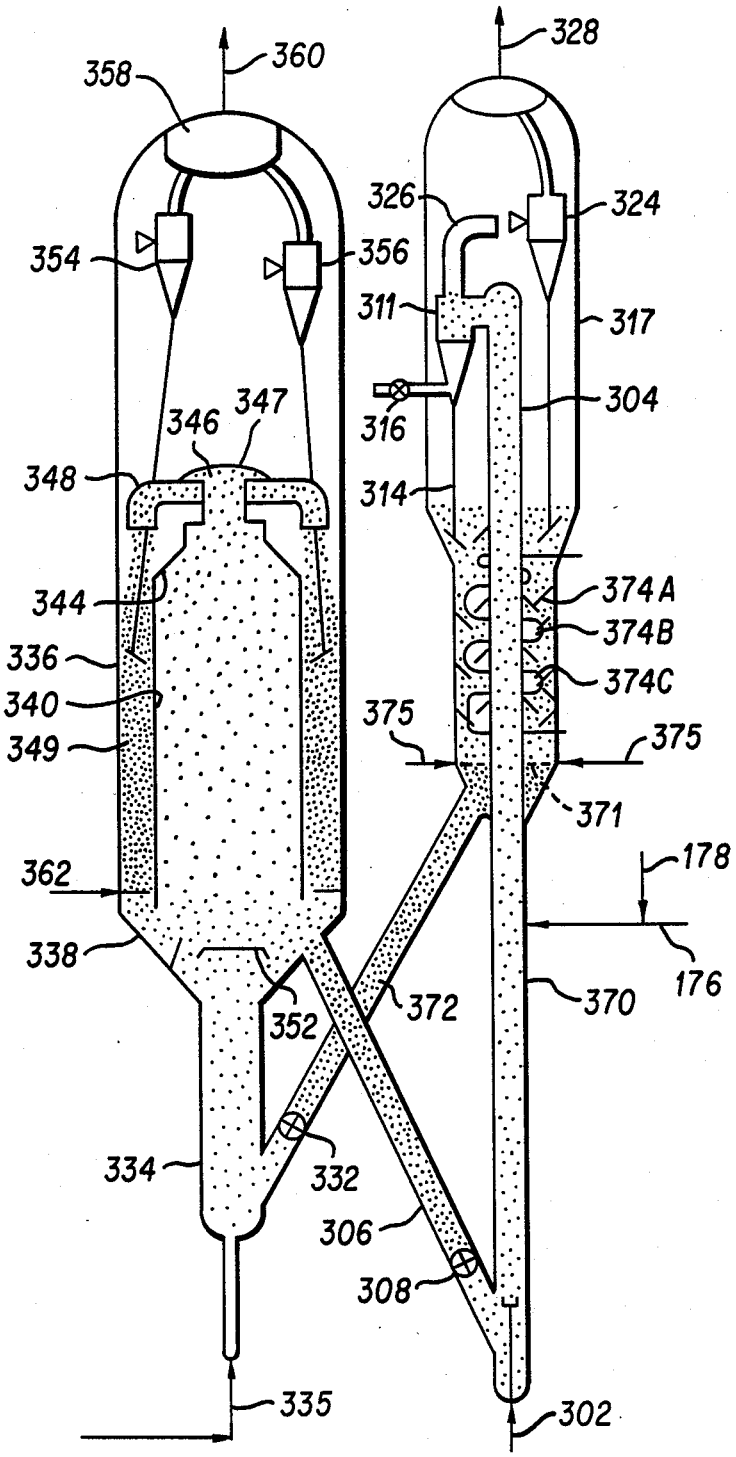
FIG. 4 is a simplified flow diagram showing a single riser FCC (fluid catalytic cracking) unit with a secondary injection point located along the riser.

FIG. 4 illustrates a single-riser FCC unit with a secondary injection point positioned along the length of the riser. The optimum placement for the olefinic gasoline injection point will vary depending on the riser temperature profile and the characteristics of the olefinic gasoline. Generally, the injection point will be located at a point along the riser having an average temperature between about 510° C. and 593° C. (950° F. and 1100° F.).

A hydrocarbon oil feed such as gas oil or higher boiling material is introduced through a conduit 302 to the bottom or upstream section of a riser reactor 370. Hot regenerated catalyst is also introduced to the bottom section of the riser by a standpipe 306 equipped with a flow control valve 308. A vapor liquid suspension is formed in the lower bottom section of the riser 370 at an elevated temperature at about 525° C. to 650° C. (980° F. to 1200° F.) and is usually at least 540° C. (1000° F.), depending on the degree of hydrocarbon conversion desired and on the composition of the feed. The suspension is formed in the bottom section of the riser and is passed upwardly through the riser under selected temperature and residence time conditions. Olefinic gasoline produced by the upstream low-severity reaction zone is charged to the riser at a point above the hydrocarbon oil feed inlet as described above. Residence of the hydrocarbon charge stock in the riser is usually between 0.1 and 15 seconds, preferably 2 to 10 seconds, more preferably 0.5 to 4 seconds, before the suspension passes through suitable separating means, such as a series of cyclones 311 rapidly effecting separation of catalyst particles from vapor hydrocarbon conversion products. Thus, in the apparatus shown in Figure, the suspension is discharged from the riser 370 into one or more cyclonic separators attached to the end of the riser and represented by a single cyclone 311. Catalyst particles separated in the cyclone 311 pass countercurrently in contact with stripping gas introduced by conduit 316 to a lower portion of the cyclone. Thus, the contacted and separated catalyst is withdrawn by a dipleg 314 for discharge into a bed of catalyst in the lower section of the reactor.

The end of the riser 370 with attached separation means 311 as shown in FIG. 4 is housed in the larger vessel 317 designated herein as a receiving and catalyst collecting vessel. The lower portion of the vessel 317 has generally a smaller diameter than the upper portion thereof and it comprises a catalyst stripping section 373 to which a suitable stripping gas, such as steam, is introduced, e.g. by a conduit 375. The stripping section is provided with a plurality of frustoconical baffles 374A, 374B and 374C (only three are designated) over which the downflowing catalyst passes countercurrently to upflowing stripping gas.

A cyclone 324 is provided in the upper portion of the vessel 316 for recovering stripped hydrocarbon products and stripping gas from entrained catalyst particles. As is well known in the art, there may also be provided additional sequential stages (not shown) of catalyst separation for product vapors discharged from the separator 311 by a conduit 326. The product mixture including high-octane gasoline product from the aromatization of olefinic gasoline leaves the vessel 317 through conduit 328 for further processing.

Deactivated stripped catalyst is withdrawn from the bottom of the stripping section by a standpipe 372 equipped with a flow control valve 332. The catalyst is then passed from the standpipe 372 into the bottom portion of a regenerator riser 334. A lift gas is introduced into the bottom of riser 334 through a conduit 335. The lift gas may comprise air or may optionally comprise preheated air or oxygen supplemented air at about 150° C. to 260° C. (300° F. to 500° F.) and about 270 kPa (25 psig) to 450 kPa (50 psig), preferably about 380 kPa (40 psig). The amount of lift gas introduced into the regenerator riser is sufficient for forming a suspension of catalyst in lift gas, which suspension is forced to move upwardly through riser 334 under incipient or partial regenerator conditions and into the bottom portion of an enlarged regenerator vessel 336. Regenerator vessel 336 comprises a bottom closure member 338 shown in the drawing to be conical in shape. Other suitable shapes obvious to those skilled in the art may also be employed, such as rounded dish shapes.

The regenerator vessel 336 comprises in the lower section thereof a smaller diameter cylindrical vessel means 340 provided with a cylindrical bottom containing a cylindrical opening in the bottom thereof, whose cross section is at least equal to the cross section of the riser 334. An annular space 349 is formed by the chambers 336 and 340 and serves to recirculate regenerated catalyst to the dense bed.

Vessel 340 is provided with a conical head member 346 terminating in a relatively short cylindrical section of sufficient vertical height capped at its upper end by means 347 to accommodate a plurality of radiating arm means 348. The radiating arm means 348 are opened in the bottom side thereof and operate to discharge a concentrated stream of catalyst substantially separated from the combustion product gases generally downward into the space 349.

In the upper portion of vessel 336, a plurality of cyclonic separators 354 and 356 is provided for separating combustion flue gas from entrained catalyst particles. The separated flue gas passes into plenum 358 for withdrawal by a conduit 360.

DESCRIPTION OF THE THIRD EMBODIMENT

In a third embodiment, a $C_2$–$C_6$ olefinic stream is converted as described in the first two embodiments. The process scheme of the third embodiment incorporates a second zeolite catalyzed reaction zone, preferably using a medium-pore zeolite, to upgrade olefinic gasoline produced in the first low-severity reaction zone.

Figure 6:
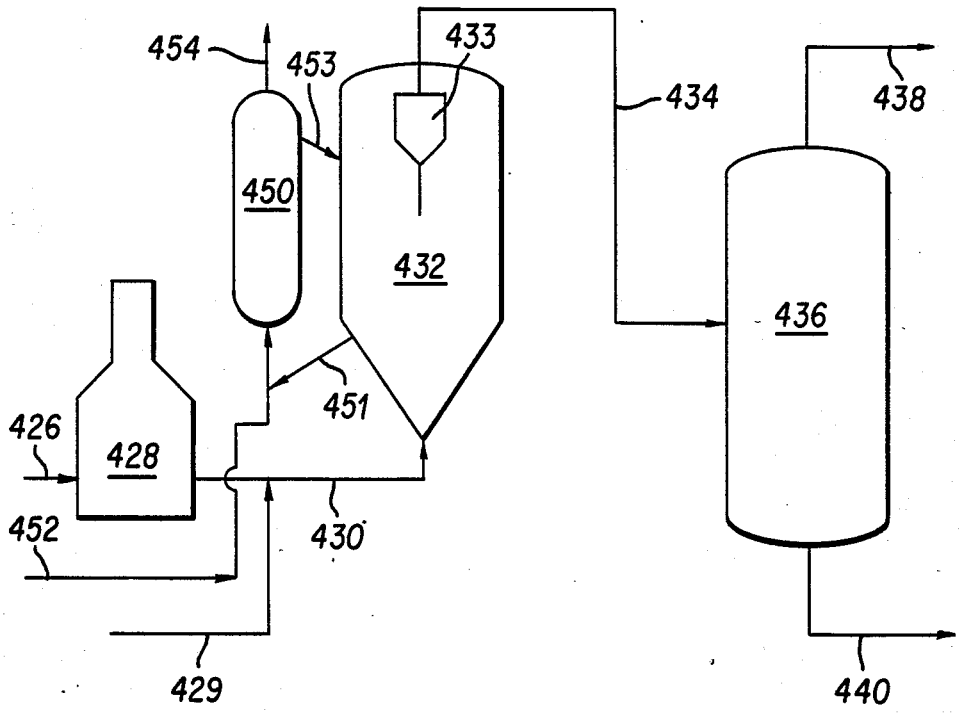
FIG. 6 is a simplified schematic diagram showing a process flow for a fluidized bed aliphatic hydrocarbon upgrading process.

Referring now to FIG. 6, olefinic gasoline flows through line 426 to heater 428 where it is reheated to a temperature suitable for oligomerization or aromatization as shown in Table 3. The hot olefinic gasoline is withdrawn from heater 428 via line 430 and mixed with a $C_2$–$C_7$ aliphatic stream flowing through line 429 and is charged to reactor 432. The reactor 432 contains a solid catalyst which preferably comprises a zeolite. The zeolite is preferably a medium-pore zeolite, for example, a zeolite having the structure of ZSM-5.

The $C_2$–$C_7$ aliphatic stream is added to increase production of high quality gasoline boiling range material. If the $C_2$–$C_7$ aliphatic stream is predominately olefinic, it is preferred to maintain reactor 432 under olefin oligomerization conditions. If, on the other hand, however, the $C_2$–$C_7$ aliphatic stream is rich in paraffins, it is preferred to maintain reactor 432 at the more severe aromatization conditions.

Process conditions may be constrained such that the flowrates and compositions of the olefinic gasoline and the aliphatic $C_2$–$C_7$ stream result in an undesirable exotherm in reactor 432. In this event, a heat exchanger (not shown) may optionally be installed inside reactor 432 to remove excess heat.

Reactor 432 may contain a fixed, moving or fluid bed of catalyst, preferably a fluid bed, most preferably a fluid bed maintained in a turbulent sub-transport flow regime. FIG. 6 shows reactor 432 as a fluid bed design with continuous catalyst regeneration unit 450.

The mixed olefinic gasoline and $C_2$–$C_7$ aliphatics flow upward through reactor 432. The catalyst becomes progressively deactivated and a portion of the catalyst is withdrawn through line 451, fluidized in a stream of oxygen-containing regeneration gas flowing through line 452 and charged to continuous catalyst regeneration unit 450 where accumulated coke is oxidatively removed. Flue gas flows out of regeneration unit 450 through line 454 while regenerated catalyst returns to reactor 432 via line 453.

Reaction products are separated from entrained catalyst in cyclone separator 433 and are withdrawn from reactor 432 via line 434. Sintered metal filters (not shown) may be installed in line 434 to further remove catalyst fines from the reactor effluent stream. Line 434 charges the reactor effluent stream to separator 436 which comprises at least one fractionation zone separating the reactor effluent into an upgraded gasoline stream flowing out of separator 436 via line 440 and a stream of $C_4$ and lighter hydrocarbon gas leaving separator 436 via line 438.

DESCRIPTION OF THE FOURTH EMBODIMENT

In a fourth embodiment of the present invention, the olefinic gasoline by-product produced by a catalytic dewaxing process is fed to the reactor riser of a single-riser FCC unit. The olefinic gasoline is injected at a point above the primary gas oil feed as detailed above in the description of the third embodiment. Catalytic cracking is endothermic and temperature decreases as the reactants flow through the length of the riser. Consequently, the optimum olefinic gasoline injection point may be determined by matching the desired process conditions with the temperature profile of the reactor riser.

Figure 3:
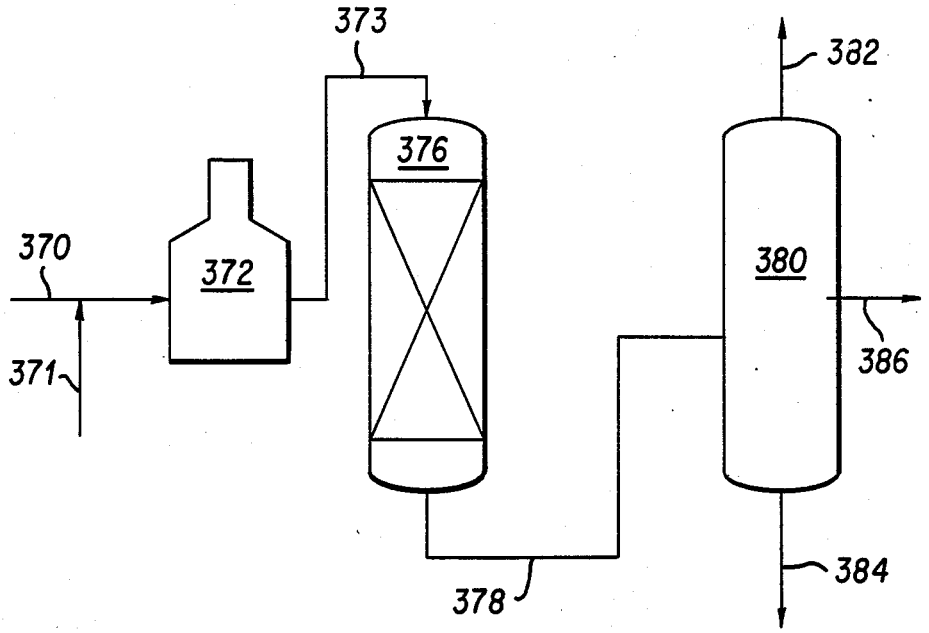
FIG. 3 is a simplified schematic diagram showing a process flow for a catalytic dewaxing process.

Referring to FIG. 3, a waxy hydrocarbon feedstock flowing through line 370 is preferably blended with a hydrogen-rich gas stream 371. Table 2, above, shows the operative range of hydrogen dosage rates. The combined flow is charged to heater 372 where it is heated to the desired reactor inlet temperature as shown in Table 2. The hot effluent stream from heater 372 flows through line 373 and enters reactor 376.

Reaction products are withdrawn from reactor 376 through line 378 and charged to separation section 380. Separation section 380 comprises at least one distillation tower carrying out a distillation well known in the art. Dewaxed product exits separation section 380 via line 384 while hydrogen and light hydrocarbon gases are removed via line 382. The mixture of hydrogen and light hydrocarbon gases may optionally be recycled to the inlet of reactor 376 (recycle line not shown). A highly olefinic gasoline stream is withdrawn from separation section 380 via line 386 and flows to the secondary injection point of an FCC reactor riser.

Conversion of the olefinic gasoline stream to an upgraded aromatic gasoline is carried out in the FCC riser as disclosed in the description of the second embodiment.

DESCRIPTION OF THE FIFTH EMBODIMENT

In a fifth embodiment of the present invention, the olefinic gasoline by-product produced by a catalytic dewaxing process is fed to the second riser of a two-riser FCC process. The catalytic dewaxing process is detailed above in the description of the fourth embodiment, while the single-riser FCC process is disclosed in the description of the first embodiment.

DESCRIPTION OF THE SIXTH EMBODIMENT

In a sixth embodiment of the present invention, the olefinic gasoline by-product produced by a catalytic dewaxing process is aromatized and upgraded in a fixed, moving or fluidized bed oligomerization or aromatization reactor system under high-severity conversion conditions. The catalytic dewaxing process is detailed above in the description of the fourth embodiment, while the oligomerization or aromatization reactor system is disclosed in the description of the third embodiment. As in the description of the third embodiment, the most preferred configuration for the high severity reaction zone is a fluid bed.

Referring to FIG. 3, a waxy hydrocarbon feedstock flowing through line 370 is optionally blended with a hydrogen-rich gas stream 371. Hydrogen dosage is shown in Table 2. The combined flow is charged to a heater 372 where it is heated to a temperature within the range of dewaxing reactor inlet temperatures shown in Table 2. The waxy hydrocarbon may be a distillate or a lube stock; process conditions are adjusted to optimize operation with each individual feedstock.

Heater effluent flows through line 374 and is charged to a first reactor 376 which is preferably a packed-bed reactor containing at least one of the medium-pore zeolite catalysts described above under conditions listed in Table 1. Reactor effluent is withdrawn through line 378 and charged to separator 380. Separator 380 comprises at least one distillation tower. Light gas exits separator 380 through line 382, dewaxed product through line 384 and olefinic naphtha through line 386. The olefinic gasoline then flows to a fixed-bed, fluid bed, or moving bed reactor system such as illustrated in FIG. 6 where it is upgraded. Preferably the reactor system is of the fluid bed design.

Referring now to FIG. 6, olefinic gasoline flows through line 426 to heater 428 where it is heated to a temperature within the range of oligomerization or aromatization reactor inlet temperatures shown in Table 3 before being mixed with a $C_2$–$C_7$ aliphatic stream flowing through line 429 and flowing through line 430 to reactor 432. The mixture is converted to an upgraded gasoline product as in the description of the third embodiment, above.

Changes and modifications in the specifically described embodiments can be carried out without departing from the scope of the invention which is intended to be limited only by the scope of the appended claims.

What is claimed is:

1. An olefin interconversion process for upgrading a predominately $C_5$– aliphatic feedstream to a primary product stream containing tertiary $C_4$–$C_5$ olefins and for producing upgraded gasoline comprising the steps of:

(a) contacting said predominately $C_5$– aliphatic feedstream with a first zeolite catalyst having a Constraint Index of between about 1 and 12 under a first set of conversion conditions including pressure between about 240 and 2170 kPa, temperature between about 230° and 385° C. and weight hourly space velocity (WHSV) between about 0.1 and 250 $hr^{-1}$ to form a primary product containing tertiary $C_4$–$C_5$ olefins and a secondary gasoline boiling range stream;

(b) separating said secondary gasoline boiling range stream from said primary product; and (c) contacting said secondary gasoline boiling range stream with a second acidic catalyst in a fluid catalytic cracking process riser reactor under a second set of conversion conditions including a catalyst to feedstock weight ratio of about 0.5 to 20, a catalyst contact time of about 1 to 50 seconds and a reaction temperature of about 420° to 600° C., to produce a gasoline product suitable for use a motor fuel blending stock.

2. The process of claim 1 wherein said second catalyst comprises a zeolite.

3. The process of claim 1 wherein said second catalyst has the structure of zeolite Beta.

4. The process of claim 1 wherein said catalytic cracking unit comprises primary and secondary riser reactors, and wherein said process further comprises charging said secondary gasoline boiling range stream to said primary riser reactor.

5. The process of claim 1 wherein said catalytic cracking unit comprises primary and secondary riser reactors, and wherein said process further comprises charging said secondary gasoline boiling range stream to said secondary riser reactor.

6. The process of claim 1 wherein said first and second catalysts have the structure of at least one selected from the group consisting of ZSM-5, ZSM-11, ZSM-22, ZSM-23, ZSM-35 and ZSM-48.

7. The process of claim 1 wherein said first and second catalysts comprise zeolites having the structure of ZSM-5.

8. The process of claim 1 wherein said second set of conversion conditions includes a catalyst to feedstock weight ratio of about 1 to 5, a catalyst contact time of about 3 to 5 seconds and a reaction temperature of about 520° to 550° C.

9. An olefin oligomerization process for converting a feedstream containing $C_6$- olefins to a primary product containing distillate boiling range hydrocarbons and for producing upgraded gasoline comprising the steps of:

(a) contacting said hydrocarbon feedstream with a first zeolite catalyst having a Constraint Index of between about 1 and 12 under a first set of conversion conditions including pressure between about 1480 and 13900 kPa, temperature between about 170° and 370° C. and weight hourly space velocity (WHSV) between about 1 and 50 $hr^{-1}$ to form a primary product containing distillate boiling range hydrocarbons and a secondary gasoline boiling range stream;

(b) separating said secondary gasoline boiling range stream from said primary product; and (c) contacting said secondary gasoline boiling range stream with a second acidic catalyst in a fluid bed catalytic cracking process riser reactor under a second set of conversion conditions including a catalyst to feedstock weight ratio of about 0.5 to 20, a catalyst contact time of about 1 to 50 seconds and a reaction temperature of about 420° to 600° C., to produce a gasoline product suitable for use as a motor fuel blending stock.

10. The process of claim 9 wherein said second catalyst comprises a zeolite.

11. The process of claim 9 wherein said second catalyst has the structure of zeolite Beta.

12. The process of claim 9 further comprising charging said secondary gasoline boiling-range stream to a primary riser reactor of a catalytic cracking unit.

13. The process of claim 9 further comprising charging said secondary gasoline boiling-range stream to a secondary riser reactor of a catalytic cracking unit.

14. The process of claim 9 wherein said first and second catalysts have the structure of at least one selected from the group consisting of ZSM-5, ZSM-11, ZSM-22, ZSM-23, ZSM-35 and ZSM-48.

15. The process of claim 9 wherein said first and second catalysts comprise zeolites having the structure of ZSM-5.

16. The process of claim 9 wherein said second set of conversion conditions includes a catalyst to feedstock weight ratio of about 1 to 5, a catalyst contact time of about 3 to 5 seconds and a reaction temperature of about 520° to 550° C.

17. An olefin oligomerization process for converting a feedstream containing $C_6$ olefins to a primary product containing lubricant boiling range hydrocarbons and for producing upgraded gasoline comprising the steps of:

(a) contacting said hydrocarbon feedstream with a first zeolite catalyst having a Constraint Index of between about 1 and 12 under a first set of conversion conditions including pressure between about 3500 and 21000 kPa, temperature between about 170° and 320° C. and weight hourly space velocity (WHSV) between about 0.1 and 10 $hr^{-1}$ to form a primary product containing lubricant boiling range hydrocarbons and a secondary gasoline boiling range stream;

(b) separating said secondary gasoline boiling range stream from said primary product; and (c) contacting said secondary gasoline boiling range stream with a second acidic catalyst in a fluid catalytic cracking process riser reactor under a second set of conversion conditions including a catalyst to feedstock weight ratio of about 0.5 to 20, a catalyst contact time of about 1 to 50 seconds and a reaction temperature of about 420° to 600° C., to produce a gasoline product suitable for use as a motor fuel blending stock.

18. The process of claim 17 wherein said second catalyst comprises a zeolite.

19. The process of claim 17 wherein said second catalyst has the structure of zeolite Beta.

20. The process of claim 17 wherein said riser reactor is the primary riser reactor of a catalytic cracking unit.

21. The process of claim 17 wherein said riser reactor is the secondary riser reactor of a catalytic cracking unit.

22. The process of claim 17 wherein said first and second catalysts have the structure of at least one selected from the group consisting of ZSM-5, ZSM-11, ZSM-22, ZSM-23, ZSM-35 and ZSM-48.

23. The process of claim 17 wherein said first and second catalysts comprise zeolites having the structure of ZSM-5.

24. The process of claim 17 wherein said second set of conversion conditions includes a catalyst to feedstock weight ratio of about 1 to 5, a catalyst contact time of about 3 to 5 seconds and a reaction temperature of about 520° to 550° C.

25. A catalytic dewaxing process for decreasing the relative wax content of a waxy hydrocarbon feedstream and for producing upgraded gasoline comprising the steps of:

(a) contacting said waxy hydrocarbon feedstream with a first zeolite catalyst having a Constraint Index of between about 1 and 12 under a first set of dewaxing conditions including pressure between about 170 and 21000 kPa, reactor inlet temperature between about 260° and 450° C. and hydrogen dosage between 0 and 3000 SCF/BBL feed to form a primary at least partially dewaxed product and a secondary gasoline boiling range stream;

(b) separating said secondary gasoline boiling range stream from said primary product;

(c) contacting said secondary gasoline boiling range stream with a second acidic catalyst in a fluid catalytic cracking process riser reactor under a second set of conversion conditions including a catalyst to feedstock weight ratio of about 0.5 to 20, a catalyst contact time of about 1 to 50 seconds and a reaction temperature of about 420° to 600° C., to produce a gasoline product suitable for use as a motor fuel blending stock.

26. The process of claim 21 wherein said dewaxing conversion conditions are lubricant dewaxing conditions including reactor inlet temperature between about 260° and 360° C.

27. The process of claim 21 wherein said dewaxing conditions are distillate dewaxing conditions including reactor inlet temperature between about 260° and 460° C.

28. The process of claim 21 wherein said second catalyst comprises a zeolite.

29. The process of claim 21 wherein said second catalyst has the structure of zeolite Beta.

30. The process of claim 21 further comprising charging said secondary gasoline boiling-range stream to a primary riser reactor of a catalytic cracking unit.

31. The process of claim 21 further comprising charging said secondary gasoline boiling-range stream to a secondary riser reactor of a catalytic cracking unit.

32. The process of claim 21 wherein said first and second catalysts have the structure of at least one selected from the group consisting of ZSM-5, ZSM-11, ZSM-22, ZSM-23, ZSM-35 and ZSM-48.

33. The process of claim 21 wherein said first and second catalysts comprise zeolites having the structure of ZSM-5.

34. The process of claim 21 wherein said second set of conversion conditions includes a catalyst to feedstock weight ratio of about 1 to 5, a catalyst contact time of about 3 to 5 seconds and a reaction temperature of about 520° to 550° C.

* * * * *

UNITED STATES PATENT AND TRADEMARK OFFICE

CERTIFICATE OF CORRECTION

PATENT NO. : 4,922,048

DATED : 5/1/90

INVENTOR(S) : M.N. Harandi

It is certified that error appears in the above-identified patent and that said Letters Patent is hereby corrected as shown below:

Columns 17 and 18, line 1 of each claim:

In claims 26, 27, 28, 29, 30, 31, 32, 33 and 34, "claim 21" should be --claim 25--.

Signed and Sealed this

Third Day of September, 1991

*Attest:*

*Attesting Officer*

HARRY F. MANBECK, JR.

*Commissioner of Patents and Trademarks*